US006755125B2

(12) United States Patent
Andrew et al.

(10) Patent No.: US 6,755,125 B2
(45) Date of Patent: Jun. 29, 2004

(54) HIGH SPEED MARKER

(75) Inventors: Neil Andrew, Sheffield (GB); Jimi Simpson, Sheffield (GB)

(73) Assignee: Edward Pryor & Son Limited (GB)

( * ) Notice: Subject to any disclaimer, the term of this patent is extended or adjusted under 35 U.S.C. 154(b) by 0 days.

(21) Appl. No.: 10/411,486

(22) Filed: Apr. 10, 2003

(65) Prior Publication Data

US 2004/0050264 A1 Mar. 18, 2004

(30) Foreign Application Priority Data

Sep. 13, 2002 (GB) ..... 0221180

(51) Int. Cl.[7] ..... B31F 13/07

(52) U.S. Cl. ..... 101/4; 160/25; 400/140; 400/141; 400/141.1; 400/142; 400/143; 400/144.3; 400/144.4; 101/127.1; 101/128.1; 101/35

(58) Field of Search ..... 160/25; 101/127.1, 101/128.1, 4, 35; 400/140, 141, 141.1, 142, 143, 144.3, 144.4

(56) References Cited

U.S. PATENT DOCUMENTS

| | | | | |
|---|---|---|---|---|
| 3,628,451 A | * | 12/1971 | McClellan et al. | 101/4 |
| 4,089,262 A | | 5/1978 | Sopora | |
| 4,557,191 A | * | 12/1985 | Speicher | 101/4 |
| 4,635,545 A | * | 1/1987 | Kubacki et al. | 101/4 |
| 4,808,018 A | | 2/1989 | Robertson et al. | |
| 5,964,542 A | * | 10/1999 | Ruhe et al. | 400/352 |
| 6,135,022 A | | 10/2000 | Troester | |
| 6,598,530 B1 | * | 7/2003 | Schneider et al. | 101/486 |

FOREIGN PATENT DOCUMENTS

| | | |
|---|---|---|
| EP | 0790133 A2 | 2/1997 |
| GB | 2370812 A | 7/2002 |

* cited by examiner

*Primary Examiner*—Edward Lefkowitz
*Assistant Examiner*—Andrea H. Evans
(74) *Attorney, Agent, or Firm*—Fish & Richardson P.C.

(57) ABSTRACT

A marking device (10) comprises a frame (1) (of frame plates (12,14)) to which are fixed first and second motors (16,18). A carriage frame (40) is pivoted in the frame about a screw axis (22). A marking head (30) is mounted on the carriage frame for movement in a direction parallel the screw axis. A drive screw (20) is rotationally mounted in the frame along the screw axis and is driven by the first motor (16). The carriage frame is journalled on said drive screw to permit said pivoting about the screw axis. The marking head is driven by rotation of the screw, the carriage frame being pivoted by the second motor.

The carriage frame (20) comprises a bar (32) on which the marking head slides. The bar is disposed parallel the drive screw. The bar has at each end an arm (34,36) pivoted on bearings (35,37) on the drive screw. One arm (36) has an extension (66) fixed to a belt (58) disposed around two idler pulleys (62,64) and a motor pulley (60) driven by the second motor. The extension has a contact surface (68) having a curvature centred on the drive screw and having both radius and circumferential extent that is sufficient to approach contact with the belt around the idler pulleys. By this means, the tension of the belt is maintained throughout its pivoting of the arm extension (66).

16 Claims, 5 Drawing Sheets

HIGH SPEED MARKER

RELATED APPLICATION

Under 35 USC 119, this application claims the benefit of a foreign priority application filed in Great Britain, Ser. No. 0221180.3, filed Sep. 13, 2002.

FIELD OF THE INVENTION

This invention relates to high speed marking devices, particularly for metal surfaces by impacted dot formation for permanent identification purposes.

BACKGROUND

It is becoming increasingly desirable to permanently mark different components in the course of manufacture. This is of particular importance in the automotive and aerospace industries, for example, where each component may require relevant markings. Marking devices can be fixed, portable, or hand-held.

For machine readable codes, precision of marking is of great importance. For other applications, precision is less important, and the main requirements may only be, for example, achieving a result readable by the naked eye. The fact that precision is of a reduced importance permits faster marking to be achieved, which is equally desirous, particularly in automated procedures. Furthermore, it is generally always desirous, particularly for handheld and portable devices, to have compact, light weight designs, which is also desired.

Marking heads that are driven by electrical solenoids are inherently slow. The time taken for a solenoid to operate to produce the marking action is unacceptably slow for high speed marking. Air-driven marking heads are used in preference, but they can also be slow when they are activated by electronically controlled valves. For higher speeds, such valves are not used. Instead, an air driven system is employed that causes the marking head to produce repetitive marking actions on a continuous basis whilst there is an operating air pressure present.

Stepper motors are commonly used to give position control for placement of the marking head within an operating envelope. They inherently provide low torque. To move the marking head at high speed generally requires torques that exceed those produced by stepper motors. Often the motor forms part of the components that the motor is attempting to move, in that the motor would also be moving itself. Thus making the motor larger compounds the problem of low torque. Moreover, the need for fast movement of the marking head increases the need for higher torque capacity.

Fast movement could be obtained through a suitable gearing ratio between the motor and the marking head, but this requires more torque capacity from the motor. Furthermore, this exacerbates a potential problem in the weight of the marking head overcoming the resistance in the system to fall to a low position when power is removed. It is desirable for this not to occur. Stepper motors have permanent magnets. The cogging torque provided by the magnets offers a degree of force that may prevent the rotor from turning when the power supply to the motors is not present. Depending on the position of the marking head, gravity may act on the marking head such that the cogging torque cannot prevent it from moving.

Some movable parts being heavy makes this worse. It is desired that, when power to the motor or motors is removed that the marking head retains its position until power is restored to the motor or motors. It is therefore desirable to have the motor separate to the moving components. This would not only reduce the load on the motor but would also reduce the weight of the movable parts.

DISCUSSION OF THE PRIOR ART

U.S. Pat. No. 4,808,018 discloses a marking device comprising a pneumatically actuated, multiple pin marking head mounted on a carriage displaceable along an axis in a carriage frame that is pivotable about that axis in base frame, translation of the carriage in the carriage frame and pivoting of the carriage frame being effected by a single motor so that the pins of the marking head are progressively tracked over a target area, each pin being actuated when a mark is to be made on the target.

Such an arrangement is not suitable for fast marking because the entire field of a marking area is traversed, even when only selected pixels of the field are to be marked, and selective control of the marking pins must be provided.

EP-A-591092 (U.S. Pat. No. 5,316,397) discloses an arrangement similar to U.S. Pat. No. 4,808,018, but where drive to the marking head is provided by independent stepper motors operating through high helix angle lead screws. Nevertheless, solenoid actuated solenoid valves selectively fire the marking pins.

U.S. Pat. No. 5,368,400 discloses a pneumatically actuated single pin marking head mounted on a carriage displaceable along two orthogonal axes by two independent motors fixed in a base frame and connected by cables and a pulley system to the carriage.

U.S. Pat. No. 6,135,022 discloses a pneumatically actuated single pin marking head mounted on a carriage displaceable on a carriage frame by a belt drive from a first motor fixed in a base frame and pivotable about an axis by a second motor fixed in the base frame

SUMMARY OF THE INVENTION

It is an object of the present invention to provide a system which is fast but has reasonable accuracy, and which overcomes the aforementioned problems, or at least mitigates their effects.

In accordance with the present invention there is provided a marking device comprising:

- a base frame;
- a first motor fixed in the base frame;
- a carriage frame pivoted in the base frame about a screw axis;
- a marking head mounted on the carriage frame for movement thereon in a first direction parallel said screw axis, the marking head comprising a pneumatically driven, continuously reciprocating, marking pin;
- a drive screw rotationally mounted in the frame along said screw axis and being driven by said first motor, the carriage frame being journalled on said drive screw to permit said pivoting about said screw axis, and the marking head being driven in said first direction by rotation of said screw; and
- a second motor fixed in the frame, the carriage frame being pivoted by said second motor.

Preferably, a drive screw pulley is disposed on the drive screw, a belt transmitting drive from said first motor to the drive screw through said pulley. The drive screw pulley may be disposed between the carriage frame and base frame.

Preferably, the drive screw has a thread pitch of about 0.1 turns per mm and said pulley provides between 2:1 and 4:1

(preferably about 3:1) drive ratio torque reduction, whereby said motor makes about 0.03 turns per mm translational movement of the carriage in the carriage frame.

Preferably, the carriage frame comprises a bar on which the marking head slides and disposed parallel said drive screw. The marking head preferably comprises a body having a front end carrying said marking pin, and a rear end through which the marking head is connected to said bar, the drive screw passing through a nut in the body intermediate said ends.

Preferably, said bar has at each end thereof an arm pivoted on bearings on said drive screw. The marking device may further comprise two idler pulleys journalled on the base frame, a motor pulley driven by said second motor, and a belt disposed around said pulleys, and one of said arms may have an extension extending away from said drive screw and be fixed to said belt between said idler pulleys so that drive from the motor pivots the carriage frame about said drive screw.

Said extension may have a contact surface having a curvature centred on the drive screw, the contact surface having both radial and circumferential extent that is sufficient to approach contact with the belt around the idler pulleys, whereby the tension of the belt is substantially maintained during pivoting of the arm extension between the idler pulleys. Preferably, the belt is fixed to said tension surface centrally thereof.

Preferably, said extension arm is carriage frame at one end of said drive screw, and said drive screw pulley is at the other end of said drive screw. Preferably, both motors are disposed for rotation about axes parallel the drive screw and are offset with respect to one another and, with respect to the marking head, are disposed behind the carriage frame.

Preferably, the base frame comprises two plates, each mounting one motor and each mounting for rotation therein one end of the drive screw. In this event, a third base component links said frame plates rigidly together. Preferably, said third base component is a casing for the marking device in the form of a box section into which marking device is slid for final assembly.

BRIEF DESCRIPTION OF THE DRAWINGS

The invention is further described hereinafter by way of example, with reference to the accompanying drawings, in which.

DETAILED DESCRIPTION OF EMBODIMENTS OF THE INVENTION

Figure 1:
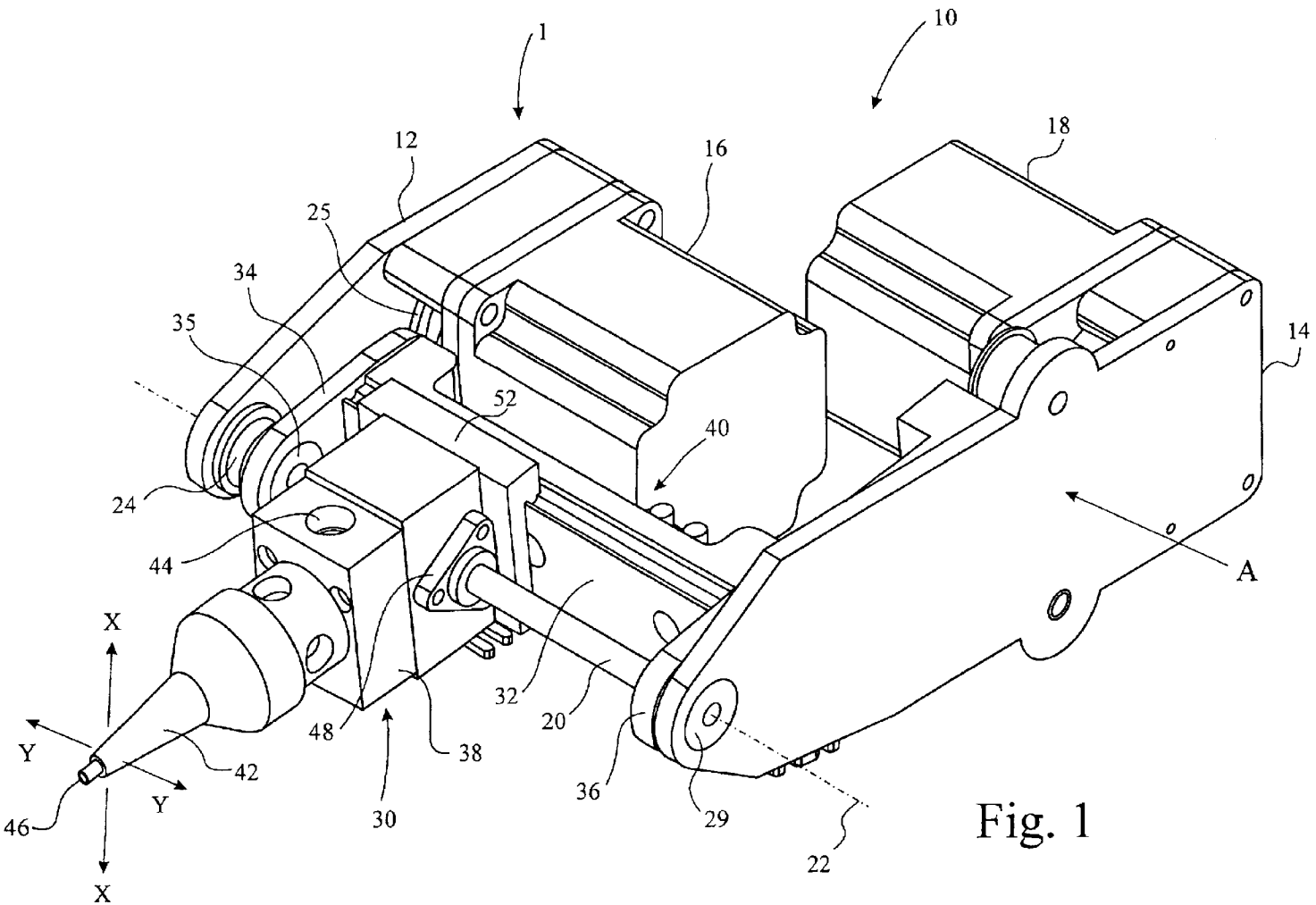
FIG. 1 is a perspective view of a high speed marker in accordance with the present invention, with part of its base frame missing, and without any belts being shown.
Figure 2:
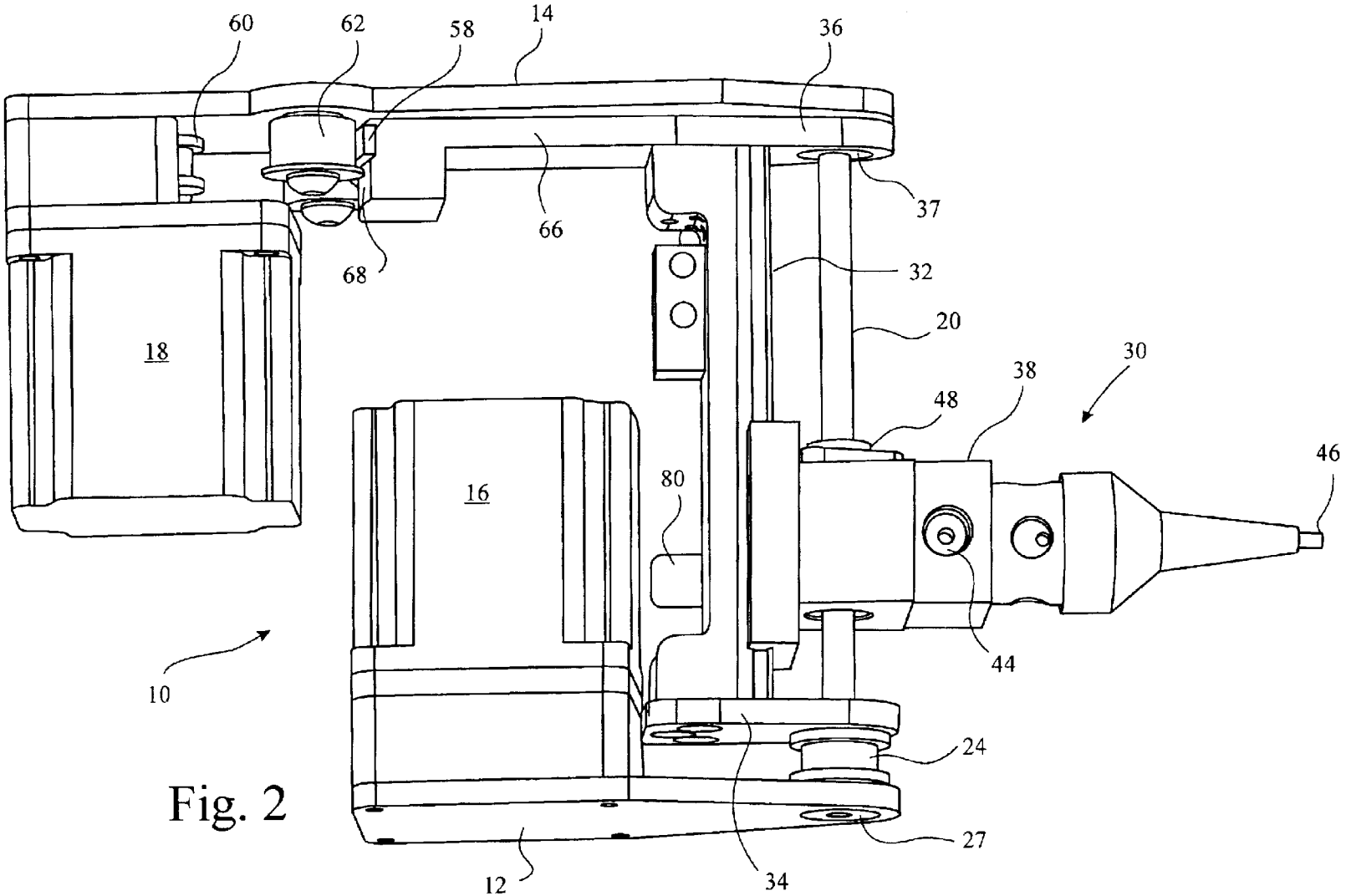
FIG. 2 is a top view of the marker of FIG. 1.
Figure 3:
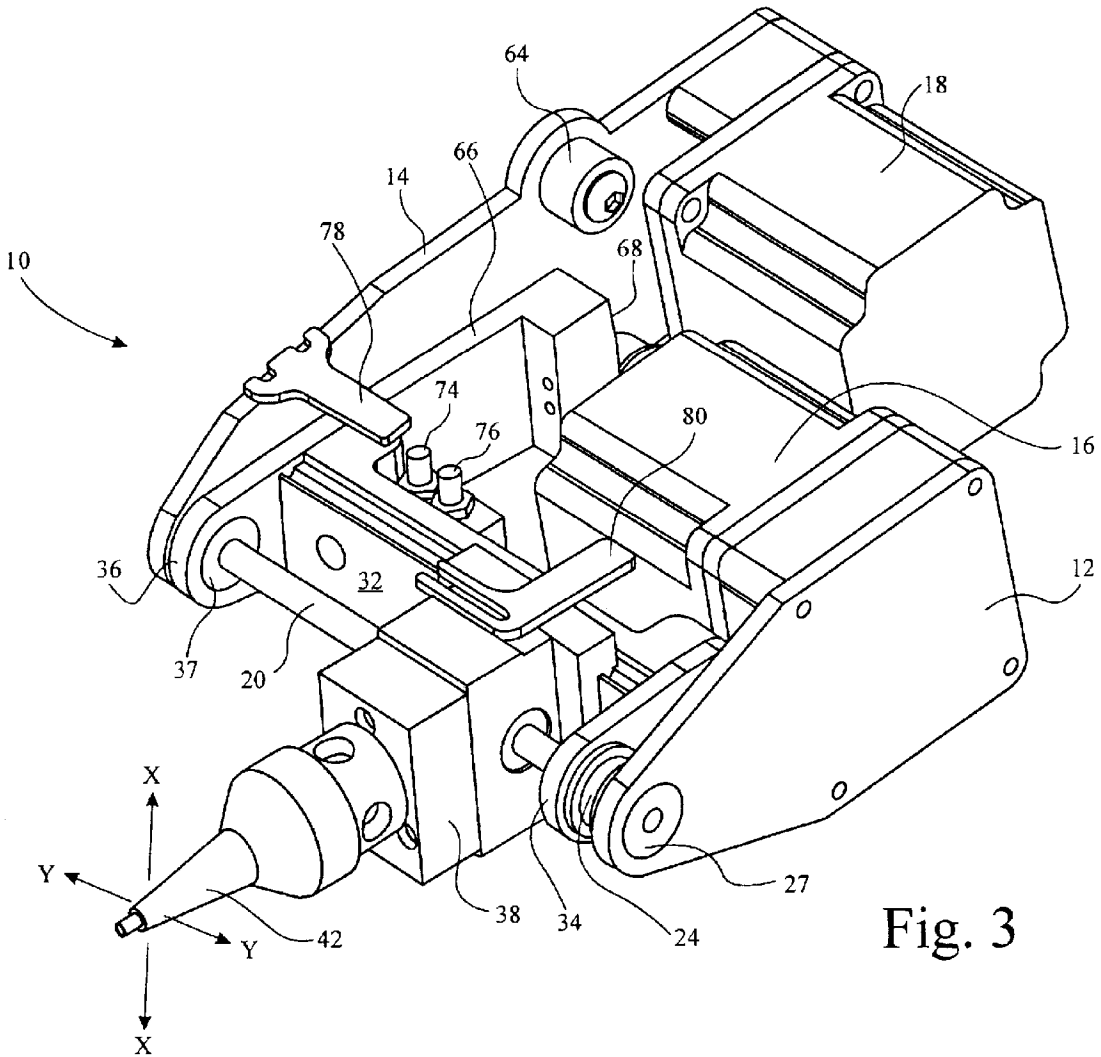
FIG. 3 is a perspective view of the bottom of the marker of FIG. 1.
Figure 4:
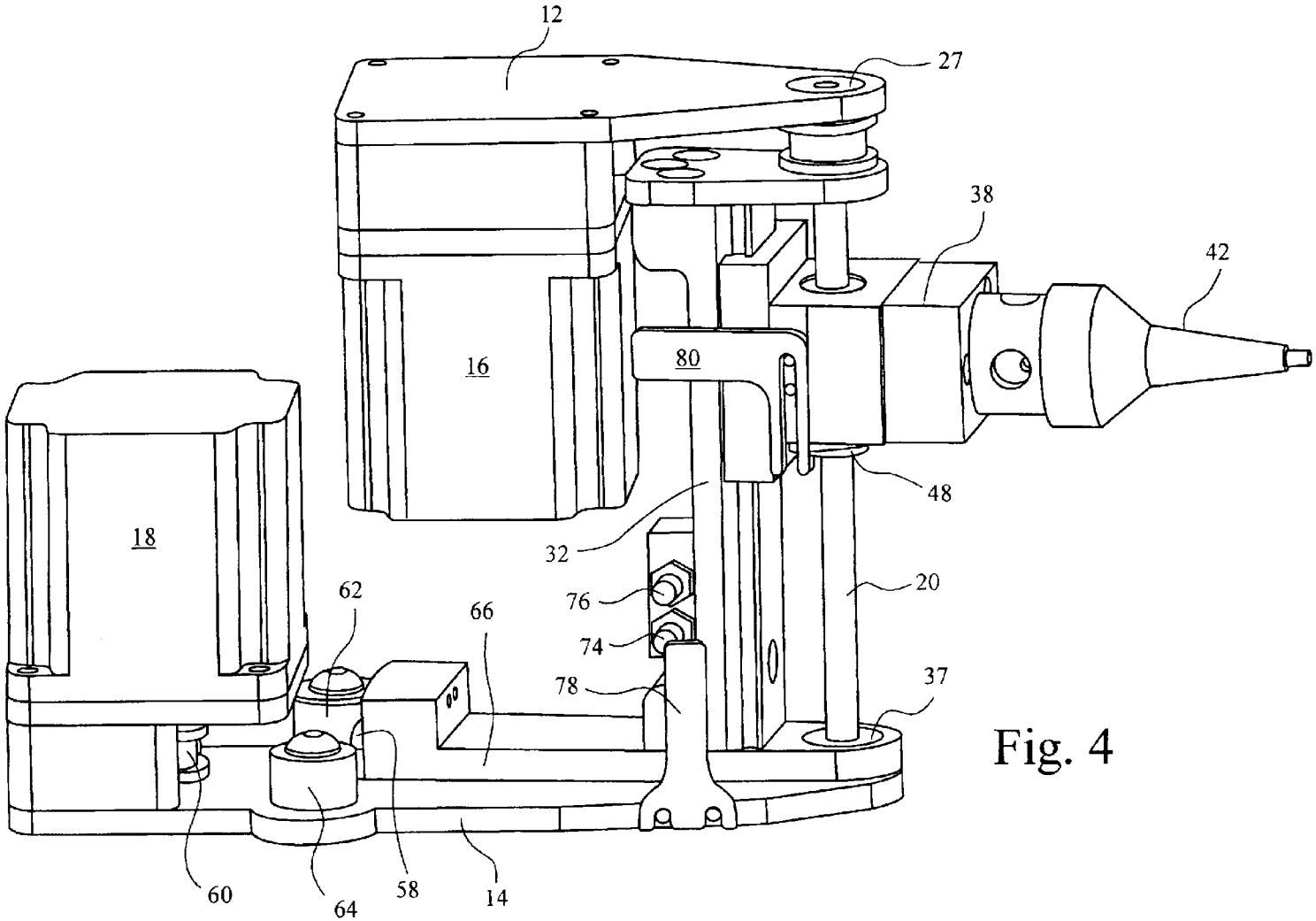
FIG. 4 is a bottom view of the marker of FIG. 1.

With reference to FIG. 1, a marking device 10 in accordance with the present has a base frame 1 in the form of two side base plates 12,14. A first motor 16 is fixed in the frame to one side plate 12, and a second motor 18 is fixed in the frame to the other side plate 14.

A drive screw 20 is rotationally mounted through bearings 27,29 in the frame 1, between the plates 12,14, about a screw axis 22. The drive screw 20 is driven by the first motor 16 through a belt (not shown) around a motor pulley 25 on the armature of the motor 16, and a screw pulley 24 on the drive screw 2.0.

A marking head 30 is slidable on a bar 32 of a carriage frame 40. The carriage frame 40 has two arms 34,36, one at each end of the bar 32. The arms 34,36 are journalled on bearings 35,37 on the drive screw 20. It is only between the arms 34,36 that the drive screw 20 is provided with a helical thread.

The marking head has a body 38 at a front end of which is formed a dot-peen marker 42 which is of conventional construction. This is of the type having a port 44 for connection to a source of air under pressure. When supplied with such air, a pin (not visible) is repeatedly driven through an end orifice 46 so that dots are impacted on a metal surface over which the marker 42 is traced.

Rotation of the drive screw 20 drives the marking head 30 in a first direction (Y—Y in FIG. 1) parallel said screw axis 22. The drive screw passes through a central region of the body 38 and through an anti-whiplash nut 48 secured in the body 38. The rear end of the body 38 has a slide element 52 that slides on the bar 32.

The carriage frame 40 is journalled on the drive screw 20 to permit pivoting about the screw axis 12. The second motor 18, fixed in the frame 1, is arranged to pivot the carriage frame 40 about the screw axis 22 and move the marking head 30 in a second, orthogonal direction (X—X in FIG. 1).

Figure 5:
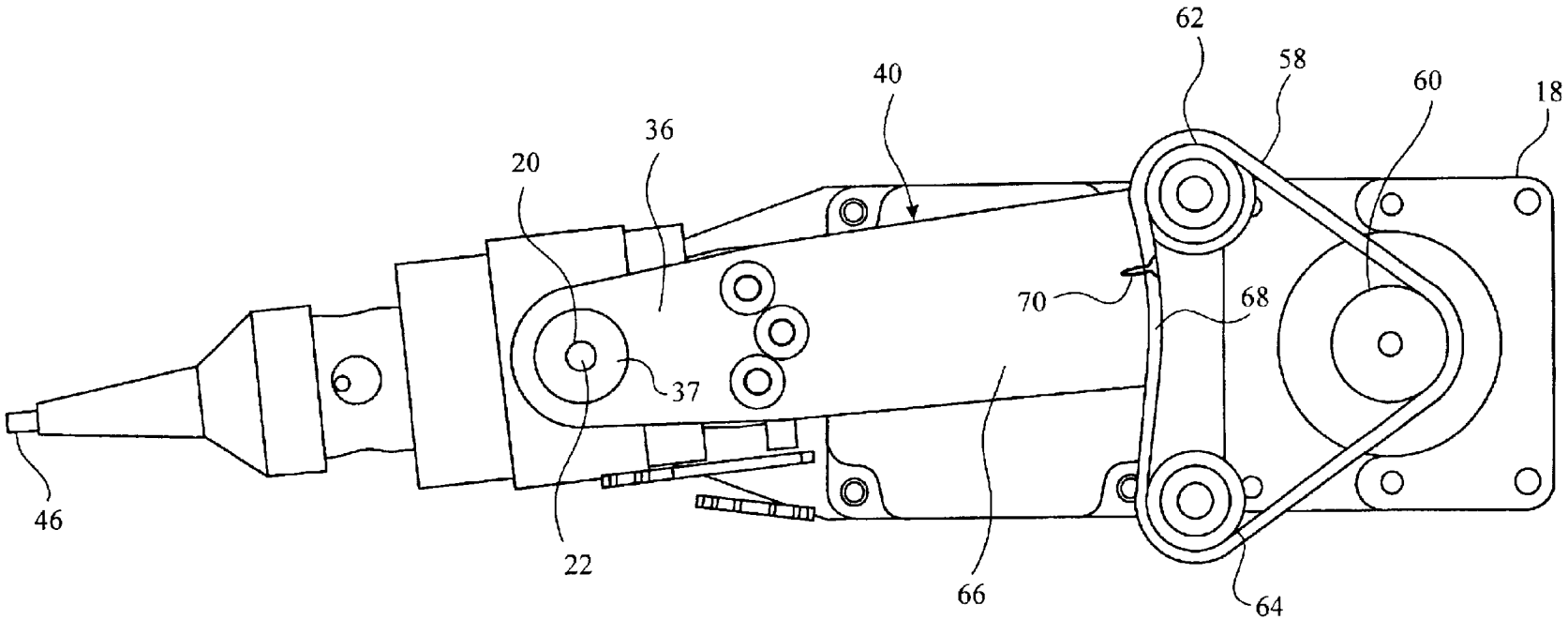
FIG. 5 is a side view of the marker of FIG. 1 in the direction of Arrow A in FIG. 1 and with a base frame side plate removed.

The second motor 18 has a toothed belt 58 (shown only in FIG. 5) engaging a motor pulley 60 of the second motor 18 and two idler pulleys 62,64 journalled in plate 14 of the frame 1. The pulleys 32 are positioned on the frame 1 between the second motor 18 and the screw axis 22 such that they are equidistant therefrom.

The arm 36 of the carriage frame 40 has an extension 66 that extends toward the two idler pulleys 62,64. The extension 66 has a contact surface 68 against which the belt 68 is pressed by its own tension between the idler pulleys 62,64. The contact surface 68 has a curvature 40 centred on the screw axis 22 and of radius such that it section is in intimate contact with the belt 58 between the two pulleys 32. Moreover, it has a circumferential extent such that it can almost be in contact with each pulley 62,64 at the same time. This extent is such that the extension 66 is still be in intimate contact with the belt 28 for all required pivoting angles of the marking head. As such the belt 58 is maintained at the same tension in all angular positions. The belt 58 physically secured to the extension 66 by a screw 70, but, in fact, the grip on the contact surface by the deflect belt 58 and the tension in the belt 58 may be sufficient connection therebetween. Indeed, by having merely a contact connection with the belt 58, the achievable pivoting angle may be greater than the angle between the pulleys 32 (subtended at the screw axis 22). The intimate contact and tension could provide enough friction between the extension 66 and belt 58 to allow fast non-slip pivoting movement of the carriage frame about axis 22 and movement of the marking head 30 in the second direction.

The ratio and relative magnitudes of the radius of the extension 66 and distance between the screw axis 22 and the tip 46 of the marking head 42 also affects the torque requirement of the second motor 18. The placement of the second motor 18 and sizes of the pulleys 60,62/64 also affect the second distance movement. Thus, for any embodiment of the present invention, the speed and magnitude of second direction movement, the second motor speed and torque, pulley size ratio, and the ratio and relative magnitudes of the radius of the extension 36 and distance between the screw axis 12 and the tip of the marking head 44, are all interrelated. Suitable selection of these parameters is therefore required to achieve the desired speed and magnitude of second direction movement.

With regard to the first motor 16, the size ratio of the pulleys 24,25 are such that a small rotation of the first motor 16 causes a larger rotation of the drive screw 20 giving more first direction movement of the marking head 30. Indeed, the ratio is about 3:1 of the pulleys 25,24.

The drive screw 20 has a screw thread pitch such that, for each revolution of the screw, the marking head is moved about 10 mm distance in the first direction. Although small pitch threads are acceptable for very fast motors, for fast movement of the marking head 16 a larger screw thread pitch is needed. Consequently, each rotation of the motor translates into about 30 mm movement of the head 30 in the Y direction.

When the first motor 16 is stationary, but the second motor 18 turns so as to pivot the marking head 16 in the second X direction, the marker head 30 also moves slightly in the first, Y direction. This potentially results in a slight diagonal movement, rather than a pure movement in the X direction, of the head 30. This diagonal movement occurs because the drive screw 20 is held stationary and the nut 48 therefore screws itself onto the screw 20 to a small extent when the marking head 30 is pivoted. This effect can be accommodated, however, by software correction to operate motor 16 to overlay a component of rotation of the screw 20 on its otherwise desired movement (if any), which component is identical to the pivoting of the head 30 being implemented by the motor 18.

When the screw axis 22 is in an essentially horizontal plane and the motors 16,18 are de-energised, the marking head 30 may be affected by gravity, causing perhaps a movement in the second direction. Likewise, if the axis is positioned vertically in a different application, the marking head may "fall" down the screw axis 20 turning the motor 16. The cogging torque, due to permanent magnets in stepper motors, tends to resist rotation of the motor and can keep the marking head 30 stationary in all positions.

This is achieved, in the case of the first Y direction and motor 18, by the centre of gravity of the carriage frame 40 and marking head 30 being substantially coincident with the axis 22. In the case of the second X direction and the first motor 16, this is achieved by minimising the weight of the marking head 30. There is a natural conflict between, on the one hand, the long pitch of the thread 20 and the pulley ratio to the drive motor 16 (which are both maximised to increase the speed of movement of the marking head in the Y direction), and, on the other hand, the fact that this makes it easier for gravity to overcome the cogging torque of the motor. Conversely, the measures that permits even greater speed (ie less mass of the marking head 30 and greater torque capacity of the motor) both reduce the tendency for slippage under zero energisation.

It is also for these reasons therefore that marking head is a simple, reciprocating, pneumatically driven, pin marker.

The compact and relatively light device is suited for connection to the end of robotic arms, for example, or for installation in static marking machines. It may also be used in hand held applications.

The motors 16,18 are ideally stepper motors so that precise position control is possible. However, home position feedback is desirable in the event of belt slippage. Therefore, sensors 74,76 on the carriage frame bar 32 detect end positions of the marking head 30 in the X and Y directions respectively. Detection elements 78,80 are positioned on the base frame 1 and marking head 30 respectively to activate the sensors 74,76 when the head reaches respective home positions in the X and Y directions.

The motors 16,18 are within the confines of the frame 1, allowing a compact arrangement. The rotor axis of each of the motors is parallel to the screw axis and spaced therefrom. The torque of a stepper motor can be increased by an increase in stack length. Since the motors 16,18 are offset from one another, they permit changes in the stack length to be effected without requiring a change in design of the marking device 10.

Because the frame plates 12,14 are separate from one another, they need to be rigidly connected together, and this is conveniently achieved by a casing (not shown) for the marking device, perhaps in the form of a box-section extrusion into which the marking device 10 can be slid as a final assembly step, screws (not shown) through the wall of the casing and into tapped holes in the base frame plates securing them to the wall of the casing.

The present invention has been described in detail with respect to various embodiments, and it will now be apparent from the foregoing to those skilled in the art that changes and modifications may be made without departing from the invention in its broader aspects.

What is claimed is:

1. A marking device comprising:

a base frame;

a first motor fixed in the base frame;

a carriage frame pivoted in the base frame about a screw axis;

a marking head mounted on the carriage frame for movement thereon in a first direction parallel said screw axis, the marking head comprising a pneumatically driven, continuously reciprocating, marking pin;

a drive screw rotationally mounted in the base frame along said screw axis and being driven by said first motor, the carriage frame being journalled on said drive screw to permit said pivoting about said screw axis, and the marking head being driven in said first direction by rotation of said screw; and a second motor fixed in the base frame, the carriage frame being pivoted by said second motor; wherein the carriage frame comprises a bar on which the marking head slides and which bar is disposed parallel said drive screw, said bar having two ends and an arm being disposed on each end of the bar, each arm being pivoted on bearings on said drive screw;

two idler pulleys are journalled on the base frame, a motor pulley is driven by said second motor, and a belt is disposed around said pulleys;

one of said arms has an extension extending away from said drive screw and being fixed to said belt between said idler pulleys so that drive from said second motor pivots the carriage frame about said drive screw;

said extension has a contact surface having a curvature centred on the drive screw, the contact surface having both radial and circumferential extent that it is substantially tangential with respect to said idler pulleys, whereby the tension of the belt is substantially maintained during pivoting of the arm extension between the idler pulleys.

2. A marking device as claimed in claim 1, further comprising a drive screw pulley, disposed on the drive screw, and a belt, transmitting drive from said first motor to the drive screw through said pulley.

3. A marking device as claimed in claim 2, in which the drive screw pulley is disposed between the carriage frame and base frame.

4. A marking device as claimed in claim 1, in which the drive screw has a thread pitch of between 0.05 and 0.5 turns per mm and said pulley provides between 2:1 and 4:1 drive ratio torque reduction, whereby said motor makes between 0.01 and 0.1 turns per mm translational movement of the carriage in the carriage frame.

5. A marking device as claimed in claim 4, in which the drive screw has a thread pitch of about 0.1 turns per mm and said pulley provides about 3:1 drive ratio torque reduction, whereby said motor makes about 0.03 turns per mm translational movement of the carriage in the carriage frame.

6. A marking device as claimed in claim 1, in which the marking head comprises a body having a front end carrying said marking pin, and a rear end through which the marking head is connected to said bar, the drive screw passing through a nut in the body intermediate said ends.

7. A marking device as claimed in claim 1, in which the belt is fixed to said contact surface centrally thereof.

8. A marking device as claimed in claim 1, in which said extension arm is on the carriage frame at one end of said drive screw, and said drive screw pulley is at the other end of said drive screw.

9. A marking device as claimed in claim 1, in which both motors are disposed for rotation about axes parallel the drive screw and are offset with respect to one another and, with respect to the marking head, are disposed behind the carriage frame.

10. A marking device as claimed in claim 1, in which the base frame comprises two plates, each mounting one motor and each mounting for rotation therein one end of the drive screw.

11. A marking device as claimed in claim 10, in which a third base component links said frame plates rigidly together.

12. A marking device as claimed in claim 11, in which said third base component is a casing for the marking device in the form of a box section into which marking device is slid for final assembly.

13. A marking device comprising:

a base frame;

a first motor fixed in the base frame;

a carriage frame pivoted in the base frame about a screw axis;

a marking head mounted on the carriage frame for movement thereon in a first direction parallel said screw axis, the marking head comprising a pneumatically driven, continuously reciprocating, marking pin;

a drive screw rotationally mounted in the base frame along said screw axis and being driven by said first motor, the carriage frame being journalled on said drive screw to permit said pivoting about said screw axis, and the marking head being driven in said first direction by rotation of said screw;

a second motor fixed in the base frame, the carriage frame being pivoted by said second motor;

a drive screw pulley, disposed on the drive screw, and a belt, transmitting drive from said first motor to the drive screw through said pulley;

two idler pulleys journalled on the base frame;

a motor pulley driven by said second motor; and a belt disposed around said pulleys; wherein:

the carriage frame comprises a bar on which the marking head slides and which bar is disposed parallel said drive screw;

the marking head comprises a body having a front end carrying said marking pin, and a rear end through which the marking head is connected to said bar, the drive screw passing through a nut in the body intermediate said ends;

said bar has at each end thereof an arm pivoted on bearings on said drive screw; and one of said arms has an extension extending away from said drive screw and being fixed to said belt between said idler pulleys so that drive from the motor pivots the carriage frame about said drive screw; wherein said extension has a contact surface having a curvature centred on the drive screw, the contact surface having both radial and circumferential extent that is sufficient to approach contact with the belt around the idler pulleys, whereby the tension of the belt is substantially maintained during pivoting of the arm extension between the idler pulleys.

14. A marking device as claimed in claim 13, in which the drive screw has a thread pitch of between 0.05 and 0.5 turns per mm and said pulley provides between 2:1 and 4:1 drive ratio torque reduction, whereby said motor makes between 0.01 and 0.1 turns per mm translational movement of the carriage in the carriage frame.

15. A marking device as claimed in claim 14, in which the drive screw has a thread pitch of about 0.1 turns per mm and said pulley provides about 3:1 drive ratio torque reduction, whereby said motor makes about 0.03 turns per mm translational movement of the carriage in the carriage frame.

16. A marking device comprising:

a base frame;

a first motor fixed in the base frame;

a carriage frame pivoted in the base frame about a screw axis;

a marking head mounted on the carriage frame for movement thereon in a first direction parallel said screw axis, the marking head comprising a pneumatically driven, continuously reciprocating, marking pin;

a drive screw rotationally mounted in the base frame along said screw axis and being driven by said first motor, the carriage frame being journalled on said drive screw to permit said pivoting about said screw axis, and the marking head being driven in said first direction by rotation of said screw;

a second motor fixed in the base frame, the carriage frame being pivoted by said second motor;

at least one idler pulley journalled on the base frame;

a motor pulley driven by said second motor; and a belt disposed around said pulleys; wherein:

the carriage frame comprises a bar on which the marking head slides and which bar is disposed parallel said drive screw;

said bar has an arm pivoted on bearings on said drive screw; and said arm has an extension extending away from said drive screw and being fixed to said belt so that drive from the motor pivots the carriage frame about said drive screw; wherein said extension has a contact surface having a curvature centred on the drive screw, the contact surface being tangential with respect to the pulleys when approaching contact therewith, whereby the tension of the belt is substantially maintained during pivoting of the arm extension between the pulleys.

* * * * *